US005406634A

United States Patent [19]

Anderson et al.

[11] Patent Number: 5,406,634

[45] Date of Patent: Apr. 11, 1995

[54] INTELLIGENT SPEAKER UNIT FOR SPEAKER SYSTEM NETWORK

[75] Inventors: Charles W. Anderson; John L. Melanson, both of Boulder; Richard C. Zwiebel, Lyons, all of Colo.

[73] Assignee: Peak Audio, Inc., Boulder, Colo.

[21] Appl. No.: 33,697

[22] Filed: Mar. 16, 1993

[51] Int. Cl.[6] ..... H04R 27/00

[52] U.S. Cl. ..... 381/82; 381/80; 381/81

[58] Field of Search ..... 381/80, 81, 82, 2, 109

[56] References Cited

U.S. PATENT DOCUMENTS

| | | | |
|---|---|---|---|
| 4,063,032 | 12/1977 | Willcocks | 381/109 |
| 4,550,400 | 10/1985 | Henderson, Jr. et al. . | |
| 4,621,374 | 11/1986 | Micic et al. . | |
| 4,862,159 | 8/1989 | Marusa et al. . | |
| 4,922,536 | 5/1990 | Hoque . | |

FOREIGN PATENT DOCUMENTS

| | | | |
|---|---|---|---|
| 60-130999 | 7/1985 | Japan | 381/82 |
| 02123193 | 1/1989 | United Kingdom | 381/82 |

OTHER PUBLICATIONS

"Experimental Digital Audio Routeing in the BBC's Radio Operations", Cutmore, N. A. F., et al., IEEE, 1992.

*Primary Examiner*—Curtis Kuntz
*Assistant Examiner*—Mark D. Kelly
*Attorney, Agent, or Firm*—Homer L. Knearl; Holland & Hart

[57] ABSTRACT

An intelligent speaker unit is controlled by control data transmitted with the digital audio data. The intelligent speaker has a Digital Signal Processor (DSP) for processing the audio data in accordance with the control data. The control data contains an address to select the speaker unit. The DSP for the speaker unit processes audio data digitally based on parameters in the control data. The processed digital audio data is then converted to an analog signal which is amplified and applied to the speaker. The digital audio data is time division multiplexed on a TDM bus. Each time slot on the TDM bus contains audio data for one digital audio channel. The control data is placed on the TDM bus as one channel (time slot) or is distributed as control bits through all the other channels. The control data also contains channel select data. Accordingly the DSP in a selected speaker unit may in turn select its audio data from a plurality of audio channels based on the control data the DSP receives. Further, the DSP may mix the selected audio channels by accumulating the audio data from the selected channels. Further, the control data contains audio control data for volume, speaker equalization and sound delay.

11 Claims, 4 Drawing Sheets

| PARAM# | PARAMETER |
|---|---|
| 0 | CHANNEL NUMBER 1 |
| 1 | MIXER GAIN 1 |
| 2 | CHANNEL NUMBER 2 |
| 3 | MIXER GAIN 2 |
| 4 | CHANNEL NUMBER 3 |
| 5 | MIXER GAIN 3 |
| 6 | CHANNEL NUMBER 4 |
| 7 | MIXER GAIN 4 |
| 8 | DELAY LENGTH |
| 9 | LOW PASS FREQUENCY |
| 10 | LOW PASS GAIN |
| 11 | PARAMETRIC FREQUENCY |
| 12 | PARAMETRIC Q |
| 13 | PARAMETRIC GAIN |
| 14 | HIGH PASS FREQUENCY |
| 15 | HIGH PASS GAIN |
| 16 | OUTPUT GAIN |

INTELLIGENT SPEAKER UNIT FOR SPEAKER SYSTEM NETWORK

BACKGROUND OF THE INVENTION

1. Field of the Invention:

This invention is directed to a method and apparatus for remote control of audio speakers. More particularly, the invention is directed to placing microprocessor intelligence in remote speakers for individual control of speakers in a network system from a central control point in the network. The invention is particularly useful in public address systems.

2. Description of Prior Art:

Public address systems have been configured traditionally with multiple speakers cabled together, and driven with a common signal or cabled together as multiple networks or zones with a common signal per zone. The common signal originates from one or more sources of audio signal selected for transmission to all speakers or to all speakers in a zone.

It is desirable to provide more flexibility in a speaker system network by being able to use separate audio signals at each speaker in the network. For example, an operator at a central point may wish to transmit a message to only selected speakers in a network, or in multiple networks or zones, rather to all speakers in a network or zone. It is also desirable to provide separate volume control at each speaker, and to selectively mix more than one audio signal at selected speakers in the network system. For example, a public address system might have music broadcast to all speakers and then mix with that music an announcement which would go to selected speakers in the system.

The advent of digital audio signals has facilitated the distribution of audio signals-from source to speakers. For example, U.S. Pat. No. 4,922,536 entitled "Digital Audio Transmission For Use In Studio, Stage Or Field Applications," uses FDM/TDM (Frequency Division and Time Division Multiplexing) to digitally transmit audio signals from multiple microphones to a control booth, and to digitally transmit audio signals from the control booth to speakers. At each end of the digital transmission, the digital signals are converted to analog signals for processing. The control booth provides the control for all the speakers. In another example, use of a microprocessor in a computing system to control routing of audio signals on a computer bus are shown in U.S. Pat. No. 4,862,159 entitled "Centralized System For Selecting And Reproducing Perceptible Programs." In both of these audio systems, the speakers are dumb devices; there is no digital audio processing at the speakers themselves.

Speakers with limited intelligence are described in U.S. Pat. No. 4,621,374 entitled "Circuit Arrangement For Processing, Transmitting, and Acoustically Reproducing Digitized Audio-Frequency Signals." This patent teaches RF transmission of digital audio signals and audio control signals to individual speakers. The audio control signals are volume, tone, balance. These control signals are processed in a signal processor before the audio signal is converted to an analog signal for the speaker. Audio signals may be transmitted to a particular speaker by using a transmission carrier frequency assigned to that speaker.

Another example of microprocessor control of a speaker is described in U.S. Pat. No. 4,550,400 entitled "Remote Digital Volume Control System." This patent uses remote speaker units having a control console at the speaker unit. The audio signals are broadcast as TDM digital audio data to all speakers. Each source of audio data is placed in a time slot on the TDM bus. A control console at the remote speaker can select an audio source by selecting a time slot, and by controlling volume to the selected audio signal. Multiple audio signals may be mixed in an analog manner at the speaker by leakage properties between the audio filter/line drivers.

Accordingly, microprocessors have been placed at remote speaker units, the microprocessors have performed only simple tasks such as volume or tone control.

SUMMARY OF THE INVENTION

It is an object of this invention to provide an intelligent speaker unit for use in a speaker network system.

It is a further object to provide an intelligent speaker unit designed for use in a speaker network system that can take full advantage of the intelligence at the remote speaker. In such a system, remote speakers may be selected, channels at speakers may be selected, selected channels may be selectively mixed at the remote speaker, the speaker may be adjusted for its environment, and all of these tasks may be accomplished by remote control.

In accordance with this invention, the above objects are accomplished by an intelligent speaker unit that reproduces sound from transmitted digital audio data while being controlled by control data transmitted with the digital audio data. The intelligent speaker unit has a Digital Signal Processor (DSP)-for processing the audio data in accordance with the control data. The control data contains an address to select the speaker unit. When the DSP detects the speaker unit's address in a control command, the DSP is enabled to process audio data digitally based on parameters in the control data. The processed digital audio data is then converted to an analog signal which is amplified and applied to the speaker.

The digital audio data is time division multiplexed on a TDM bus. Each time slot on the TDM bus contains audio data for one digital audio channel. The control data is placed on the TDM bus as one channel (time slot), or is distributed as control bits through all the other channels. The control data .contains channel select data and audio control data. The DSP in a selected speaker unit selects its audio data from a plurality of audio channels based on the channel select data the DSP receives. Further, the DSP may mix the selected audio channels by accumulating the audio data from the selected channels.

The audio control data contains control data for one or more controls including volume, speaker equalization and sound delay. The DSP, when it processes the audio data, controls the volume, adjusts the frequency response for equalization and delays the data to compensate for sound delay between speakers. If a plurality of channels are mixed at the speaker unit, the audio control data may be used to control the mixed audio data, or it may be used to control the audio data in each audio channel before the channels are mixed.

The great advantage of placing more intelligence in the remote speaker units is that it gives the unit the capability and flexibility to accomplish all the objectives described above. Other objects, advantages and features of the invention will be understood by those of ordinary skill in the art after referring to the complete written description of the preferred embodiments in conjunction with the following drawings.

DESCRIPTION OF THE PREFERRED EMBODIMENTS

Figure 1:
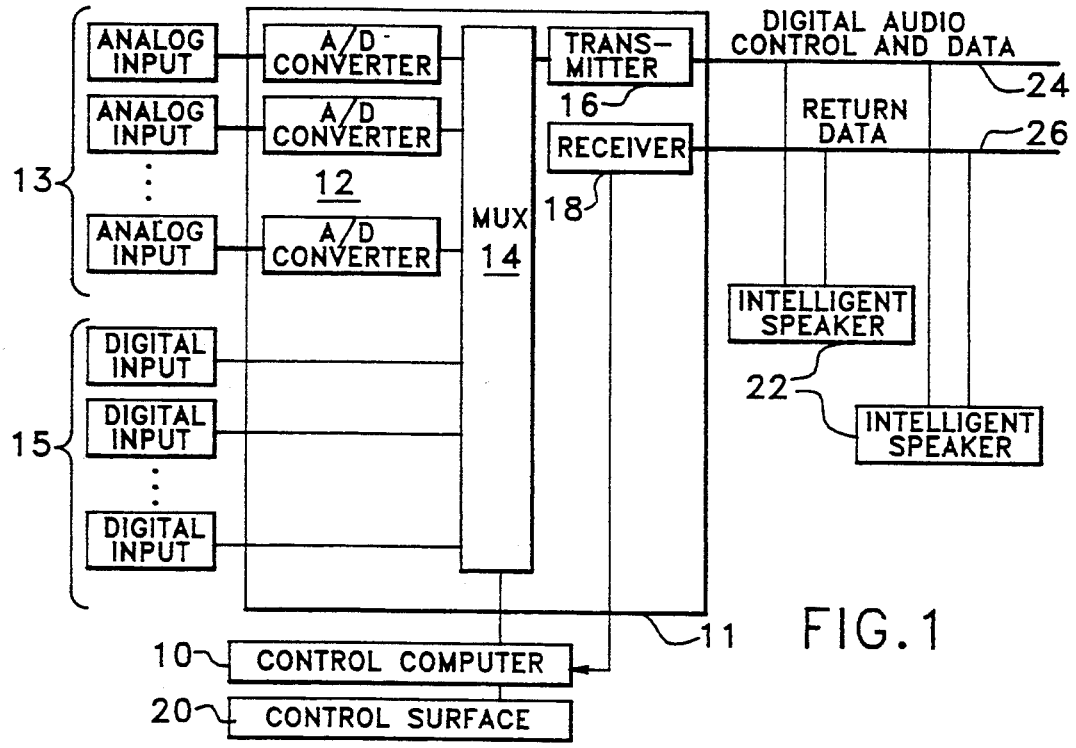
FIG. 1 illustrates a speaker system network with the components that transmit the audio and control data to the intelligent speaker units.

In FIG. 1, the heart of the audio/control data transmission control center is a control computer 10 with the control board 11. The control board contains analog-to-digital converters 12, a multiplexing (MUX) circuit 14, transmitter 16 and receiver 18. Control computer 10 in the preferred embodiment is a personal computer containing a microprocessor, such as an Intel 386 or 486 connected in an ISA bus architecture. The control board 11 would be an add-on board attached to the I/O bus and packaged inside the computer cover. The control surface 20 could be a keyboard with adjustable audio controls on a panel, but is preferably a keyboard and a computer display screen having a windowing control screen that is computer mouse controlled by the operator. The window display screen will be described hereinafter with reference to FIG. 6.

MUX 14 receives digital audio data from A/D converters 12 or from digital audio sources 15. Converters 12 convert analog audio signals from inputs 13 to digital audio data. Thus, the system will handle either analog or digital input audio sources. MUX 14 also receives control data from computer 10 for transmission to intelligent speaker units 22.

A plurality of intelligent speaker units 22 are attached to the digital audio control and data bus 24 to receive the transmitted audio data and control data from transmitter 16. Each speaker unit is also connected to the return data bus 26. Receiver 18 on the control board receives speaker unit status and/or control information from the speaker units over the return data bus.

Figure 2:
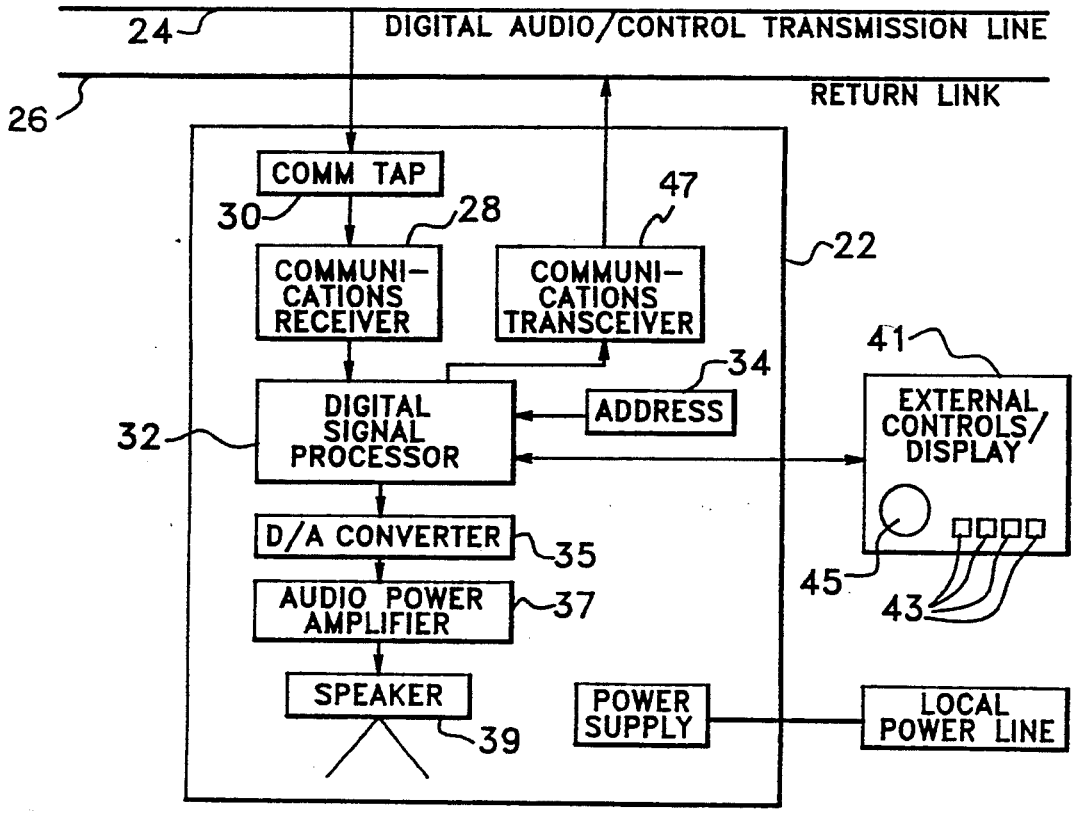
FIG. 2 shows one preferred embodiment of the intelligent speaker unit connected to a TDM bus or transmission line.

The preferred embodiment of the intelligent speaker unit is shown in FIG. 2. The digital audio and control data from transmitter 16 in FIG. 1 is received via time division multiplex bus 24 by communications receiver 28. Receiver 28 is a TAXI (Transparent Asynchronous Transmitter-Receiver Interface) receiver that operates in accordance with MADI digital audio interface format. The MADI format is a multiplex implementation of the AES/EBU format. The MADI format for digital audio along with TAXI transmitters and receivers available from Advanced Micro Devices are described in an article entitled "The MADI Format: Applications and Implementation in the Digital Studio" by P. S. Lidbetter, *Proceedings of AES 7th International Conference,* pp. 251–261, (March, 1990). The transmitters, receivers and transceivers shown herein are preferably implemented as taught in the Lidbetter article.

Receiver 28 is connected to the TDM line 24 through a communication tap 30. Tap 30 is a high impedance tap for the digital signal on the TDM line so that receiver 28 may sense the digital signal without dissipating the signal. The digital signal is passed along TDM line 24 to many speaker units; the only limitation on speaker units being the size of the address word used to select one or a group of speaker units.

Receiver 28 performs a demultiplexing operation on the audio and control data multiplexed by MUX 14 in FIG. 1. For example, 56 channels or time slots are transmitted in a MADI frame structure by transmitter 16. Receiver 28 synchronizes itself to the pulse transitions in the digital data received over line 24. The beginning of a frame is detected by the receiver looking for a pattern of digital bits that mark beginning of frame. Thereafter, the receiver counts bits received after beginning of frame to identify the start of each time slot in the frame. As each time slot is segmented by the receiver 28, it passes the digital data in that, slot to digital signal processor 32.

Digital Signal Processor (DSP) 32 contains ROM for storing its control programs and audio processing programs. DSP 32 also has working storage in the form of RAM and/or registers. Each time slot contains a 48 bit word which is applied to an input port of the DSP by receiver 28, as each channel time slot is demultiplexed. The control data for the speaker unit may be embedded as assigned bits in each time slot, or may be collected in one 48 bit time slot. In the latter event, the number of available channels is reduced by one. If the control data is embedded in the other channels, then multiple time slots or channels must be processed by the receiver before it passes a 48 bit control command or message to the DSP.

The format of the control message is <Speaker Unit Address> <Parameter #> <Parameter Data>. The address is a 16 bit number used by the control computer 10 to identify which speaker unit, or units, are to be active (enabled). Each speaker unit has an address which is set by a DIP switch module 34. DIP switches are used so that, if speaker units are replaced, the replacement unit may be set to the same address as the replaced unit. The Parameter # is an 8 bit number that specifies the control parameter which the 24 bit Parameter Data corresponds to.

DSP 32 runs a control program and an audio processing program. These programs run asynchronously. The control program enables the speaker unit and sets audio control parameters; the audio processing program uses the audio control parameters to digitally control the characteristics of the audio signal. The processed digital audio signal passes, via an output port on DSP 32, to the digital-to-analog (D/A) converter 35. The analog audio signal from converter 35 is amplified by amplifier 37, and the amplified audio signal drives speaker 39 to reproduce the sound selected for the speaker unit 22.

An optional external control at speaker unit 22 may be provided. An operator at the speaker unit could use the optional controls/display 41 to override control parameters transmitted from control computer 10 (FIG. 1). For example, an operator might use select switches 43 to select the audio channel or channels to be reproduced at the speaker unit, or might adjust the volume at speaker unit by adjust of control dial 45. Transceiver 47 is provided with return link 26, whereby the remote console 41 and the central computer 10 might exchange control information or status.

Figures 3, 4:
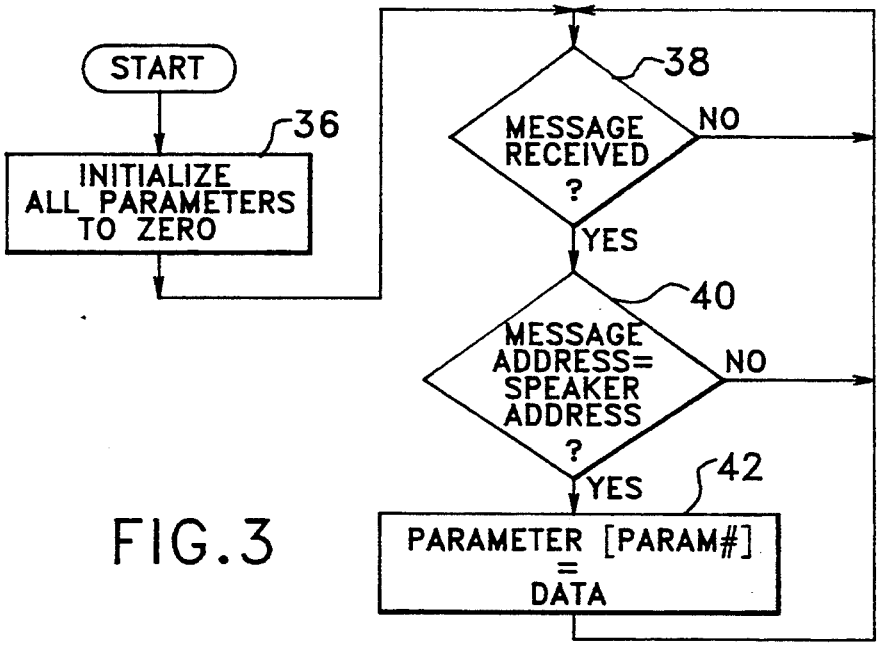
FIG. 3 illustrates the process/functional flow of operations performed by the digital signal processor in the intelligent speaker unit when processing the digital control data.
FIG. 4 is a table of parameters used in the control command or control data sent to the intelligent speaker unit.

The control program for enabling a speaker unit 22, and setting parameters for the speaker unit, is shown in FIG. 3. When the speaker unit powers on, it comes up in DSP 32, and the power on routines in DSP 32 call the control program in FIG. 3. The first operation 36 of the control program initializes, or resets, all the parameter values stored in working storage in the DSP to zero. Resetting all the parameters to zero effectively disables the functioning of the speaker unit because all the audio gains are set to zero. The speaker unit is enabled from control computer 10 when the speaker unit is addressed in a control message from the control computer 10, and its parameters are set to operative values by the control message. The speaker unit may also be disabled from the control computer 10 by the computer addressing the speaker unit and resetting all the parameters to zero.

Decision 38 tests for the presence of control messages on the TDM line. If receiver 28 (FIG. 2) decodes (or demultiplexes) a control message from line 24, the control message is passed to DSP 32. Decision 38 detects the presence of the control message and branches Yes to decision 40. If there is no control message, decision 38 branches No, and continues to loop looking for control messages. Decision 40 tests whether the address in the control message matches the address of the speaker unit 22 as set in the DIP switches 34. If there is no match, the control program loops back to decision 38 to look for the next control message. If the addresses match, the control program branches Yes to operation 42.

Operation 42 reads the parameter number and accompanying parameter data for the parameter number, and loads that parameter data into a defined storage location in DSP 32 for the parameter number. The control program continues to load parameter values into defined parameter locations in the DSP. Subsequently, the audio processing program, running asynchronously with the control program, reads parameter data from the defined storage locations and uses the parameter data in the audio processing program.

The control parameters are listed in the table in FIG. 4. There are 17 parameters in the preferred embodiment. Parameter Numbers 0–7 are allocated to the selection of four channels and the volume of each of those channels whereby the DSP may mix up to four selected channels. Accordingly, parameters 0–7 are the mix control parameters. Parameter 8 sets the sound delay for the speaker unit. Parameters 9–10 set the low pass frequency and the low pass gain. Parameters 11–13 set the parametric frequency (center of mid-range frequency), Q (bandwidth of mid-range frequency) and parametric gain (mid-range gain). Parameters 14–15 set the high pass frequency and the high pass gain. Finally, Parameter 16 sets the output gains. These parameters are used by the audio processing program.

Figure 5:
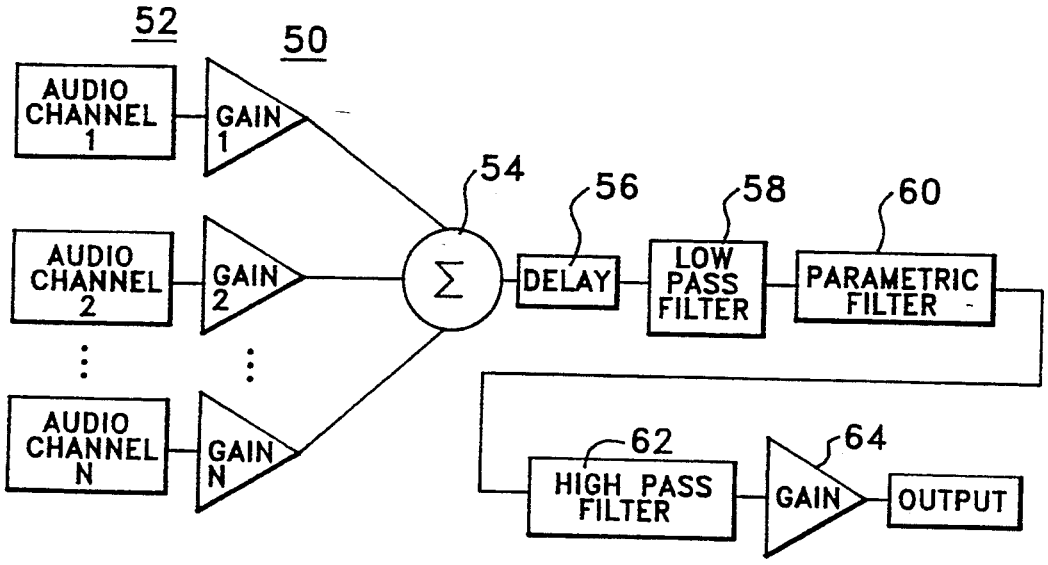
FIG. 5 illustrates the process/functional flow of operations performed by the digital signal processor in the intelligent speaker unit when processing the digital audio signals.

In FIG. 5, the audio processing program, executed by DSP 32, is illustrated as a functional flow diagram. In operation, DSP multiples at operation 50 the audio data for a selected channel 52 by the gain for the selected channel. Whereas the parameters for four channels are shown in the table of FIG. 4, N channels are depicted in FIG. 5. The number of channels is only limited by available length of the command message and the power of the DSP.

Audio channels 52 are mixed by the DSP reading and using the mix control data or parameters. Parameters 0, 2, 4 or 6 (FIG. 4) are channel select data; they are read by DSP from its working storage, and used to access and read the audio data of the selected channels from working storage. The gains for the respective channels are read from the working storage for Parameters 1, 3, 5 and 7. As the audio word for each selected channel is read, DSP multiplies 52 the digital word by the respective gain for that channel and accumulates 54 the result in an accumulation register or storage location. In this way, multiple channels may be mixed by accumulating the selected channel digital audio words as multiplied by their gains in the accumulation storage.

DSP delays 56, the digital audio word read from accumulation storage to compensate for sound delays between speakers. The DSP reads the delay from Parameter 8 storage location. Sound delays are set depending on the location of speakers, the expected clusters of listeners and their location relative to the speaker. The objective is that a cluster of listeners receive the same sound from different speakers at the same time.

After being delayed, the digital audio data is processed for speaker equalization—adjusting the speaker for its environment. Low pass filtering at operation 58 is accomplished by reading the low pass frequency and gain from Parameters 9 and 10. The DSP then boosts, or reduces, the gain of any frequency components below the low pass frequency according to the low pass gain value. Parametric filtering at operation 60 uses Parameters 11–13, and applies a gain (Parameter 13) for frequency components within bandwidth Q (Parameter 12) of the parametric frequency (Parameter 11). High pass filtering at operation 62 boosts, or reduces, the gain of any frequency above the high pass frequency in accordance with the high pass gain value.

The audio processing program is completed by multiplying 64, the equalized digital audio word, by the output gain (Parameter 16). The gains multiplied in operation 50 control the mixing of the selected channels. The output gain multiplied times the digital audio word in operation 64 controls the sound volume produced by the speaker unit. The processed mixed audio digital word is passed via the output port of DSP 32 to D/A converter 35 for conversion to the analog audio signal.

Figure 6:
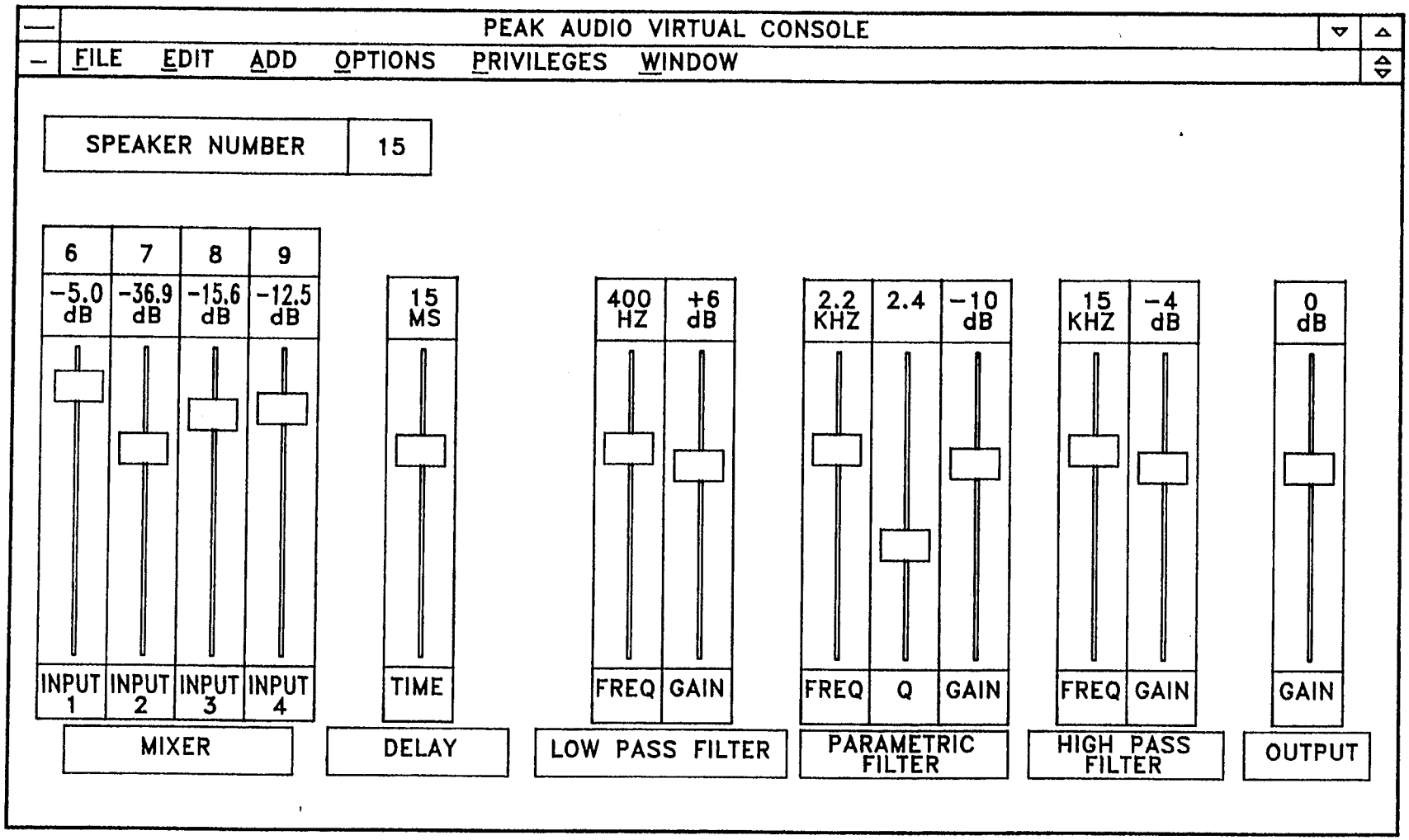
FIG. 6 illustrates the preferred operator control interface at the transmission center control console. The interface is a windows display screen where operations are selected and adjusted by computer mouse control.

FIG. 6 shows the window screen interface for the operator at the control computer 10. The operator would select a speaker number by placing the mouse cursor on the speaker number field and keying in the number. Speaker unit 15 is shown selected in FIG. 6. Likewise, the audio channels would be selected in the same manner as the speaker number. Channels 6, 7, 8 and 9 are shown selected in FIG. 6. Parameter values for gains, frequencies and Q would be selected by placing the mouse cursor on the slide control knobs depicted in the window and dragging each control knob up or down with the mouse. Values for these parameters change as the slide knob is moved.

Figure 7:
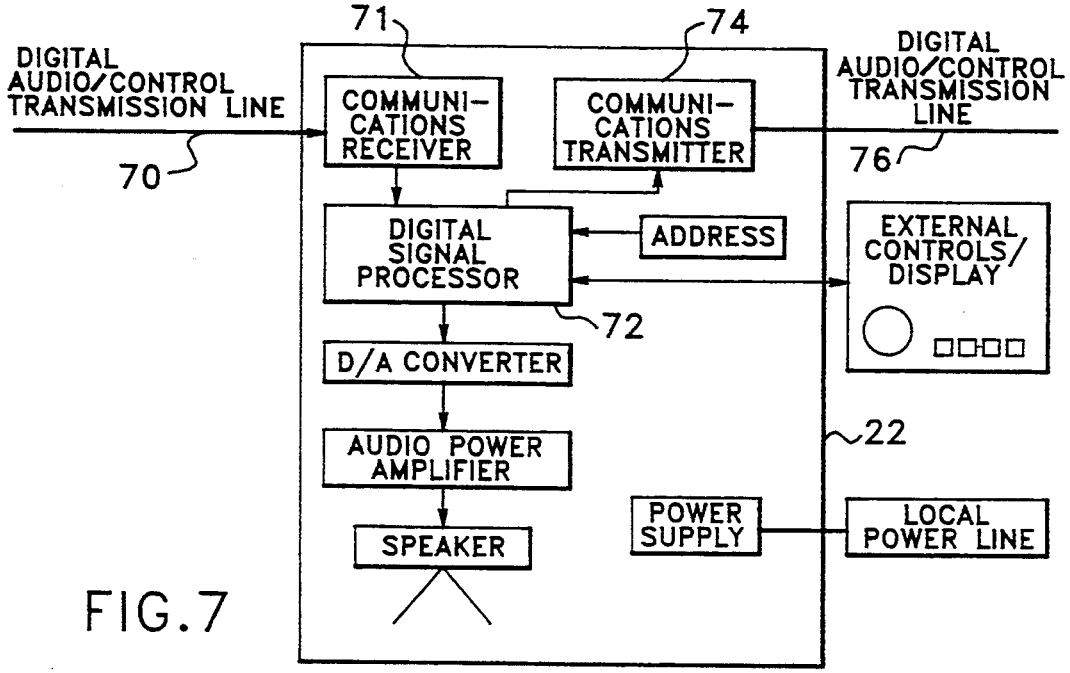
FIG. 7 shows the intelligent speaker unit connected to a ring data bus.

FIG. 7 shows an alternative preferred embodiment where the intelligent speaker unit 22 is connected in a ring network of speakers. In this configuration, the frame containing the digital audio channels is received over TDM line 70 by receiver 71, and the digital audio channels and control messages are loaded into DSP 72. DSP 72 operates in the same manner as described above for DSP 32 (FIG. 2) but, in addition, DSP 72 passes all of the digital audio channels and control messages to transmitter 74. Transmitter 74 regenerates the frame and transmits the frame on the TDM line 76 to the next intelligent speaker unit in the ring.

In addition to the alternative network configuration, other equivalent variations on the invention might be implemented by one skilled in the art. For example, DSP 32, rather than loading all digital words for all channels in its working storage, might cooperate with receiver 28 to load in its working storage only the audio digital words from selected channels as identified by the channel select parameters. The address in DIP switches 34 might instead be a settable parameter controlled by control computer 10 after the speaker was addressed the first time. Multiple speakers and stereo configurations could be implemented at each speaker unit. The analog circuits of the speaker units could be physically packaged separate from the digital circuits.

While a number of preferred embodiments of the invention have been shown and described, it will be appreciated by one skilled in the art, that a number of further variations or modifications may be made without departing from the spirit and scope of our invention.

What is claimed is:

1. In a public address system having a transmission control center for transmitting digital audio data from multiple audio sources, intelligent speaker apparatus remote from the transmission control center for reproducing mixed audio signal sound from digital audio data from a plurality of the audio sources, the audio data from each audio source being transmitted as a distinct digital audio channel by the control center to said apparatus, said apparatus being controlled by control data transmitted by the control center, said apparatus comprising:

processing means for processing the audio data to produce an audio signal;

speaker means responsive to the audio signal for reproducing sound;

said audio data includes audio data from more than one digital audio channel;

said control data including audio control data and channel select data;

channel select means responsive to the channel select data for selecting a plurality of the audio channels to provide audio data for processing by said processing means; and said audio control data includes audio control data for audio data in each selected channel; and processing means responsive to the audio control data for controlling the audio characteristics of the audio data in each selected channel to produce controlled audio data for each selected channel;

said processing means responsive to said channel select means for accumulating controlled audio data from the selected channels and thereby mixing controlled audio signals from a plurality of selected channels to generate the mixed audio signal;

said speaker means responsive to the mixed audio signal for reproducing sound from selected channels and the sound from each channel being controlled by the audio control data for the channel.

2. The apparatus of claim 1 and in addition:

said control data includes audio control data for each speaker means; and means responsive to the audio control data for controlling the audio characteristics of the accumulated audio data.

3. The apparatus of claim 1 wherein:

said control data includes an address unique to the intelligent speaker apparatus; and enabling means responsive to said address for enabling said processing means.

4. The apparatus of claim 3 wherein said control data includes control parameters for the processing performed by said processing means and said processing means comprises:

digital signal processing means for processing digital audio data in accordance with the control parameters; and conversion means for converting the processed digital audio data from said processing means into an analog signal for said speaker means.

5. The apparatus of claim 4 and in addition:

said control parameters include audio control data for controlling one or more audio characteristics including volume, equalization and sound delay for said speaker means; and said digital signal processing means responsive to the audio control data for controlling one or more of the volume, equalization and sound delay in the processed audio data prior to conversion of said data by said conversion means.

6. In a public address system having a transmission control center and a plurality of remote intelligent speaker units where said control center transmits digital audio data from a plurality of audio sources over a plurality of channels and also transmits audio control data, a method for selectively reproducing sound at each intelligent speaker unit from digital audio data in a plurality of the channels, said method controlling the sound reproduced at the speaker unit in accordance with control data transmitted with the digital audio data, said control data includes speaker select data, channel select data and audio control data, said method comprising the steps of:

setting channel select data and audio control data in said speaker unit if said unit is selected by the speaker select data;

selecting a plurality of the audio channels for mixing at the selected speaker unit in accordance with the channel select data;

said channel select data includes channel audio control data for each selected channel;

processing the audio data in each selected channel in accordance with the channel audio control data for the channel to produce channel-controlled audio data;

accumulating the channel-controlled audio data from the selected audio data channels to produce accumulated channel-controlled audio data;

processing the accumulated channel-controlled audio data from selected channels to produce a channel-controlled mixed audio signal; and reproducing sound from the channel-controlled mixed audio signal.

7. The method of claim 6 and in addition:

resetting said processing step to an inoperative state whereby no sound is produce by the intelligent speaker unit until channel select data and audio control data are set in the unit by said setting step.

8. The method of claim 6 wherein:

said speaker select data comprises an address for the intelligent speaker unit;

said channel select data comprises mix control parameters including channel select parameters and gain control parameters;

said selecting step selecting the channels based on the channel select parameters;

processing audio data from the selected audio channels in accordance with the gain control parameters for each selected channel; and said accumulating step accumulates the gain processed audio data from the selected channels to produce mixed audio data.

9. The method of claim 8 wherein:

said audio control data comprises audio control parameters for controlling one or more audio characteristics including volume, equalization and sound delay for the speaker unit; and said processing step processes the accumulated audio data in accordance with audio control parameters to control one or more of the volume, equalization and sound delay in the accumulated audio data.

10. Sound distribution apparatus in a public address system for controlling the distribution of audio information contained in two or more selected channels to selected audio devices and independently controlling the sound produced from each selected channel at each selected audio device, said apparatus comprising:

a plurality of audio information sources;

a speaker subsystem at each audio device having means for reproducing sound from received audio information, a mixing means, an audio processing means and an enabling means;

control center means for transmitting the audio information from each of a plurality of the audio sources to said speaker subsystems and for transmitting audio control information, mixing control information and address information to said speaker subsystems;

said enabling means responsive to the address information for enabling a speaker subsystem identified by the address information;

said mixing means responsive to said mixing control information for selecting two or more channels of audio information, the selected channels being identified by said mixing control information, and said mixing means for controlling the gain of each of the selected channels in accordance with said mixing control information to produce mixed audio information; and said audio processing means responsive to said audio control information for controlling the audio characteristics of mixed sound from the mixed audio information in accordance with control parameters in the audio control information.

11. The apparatus of claim 10 wherein:

said audio control information includes volume control, speaker equalization control and sound delay control parameters; and said audio processing means responsive to the control parameters for controlling volume, equalization and sound delay in the reproduction of mixed sound from the selected channels at each audio device.

* * * * *